US005499672A

United States Patent [19]

Nakashima et al.

[11] Patent Number: 5,499,672

[45] Date of Patent: Mar. 19, 1996

[54] MOLD FOR CONTINUOUS CASTING WHICH COMPRISES A FLAME SPRAYED COATING LAYER OF A TUNGSTEN CARBIDE-BASED WEAR-RESISTANT MATERIAL

[75] Inventors: Kunio Nakashima; Ryoichi Ishigane; Takayuki Tanaka; Kenzo Yamamoto, all of Toyama, Japan

[73] Assignee: Chuetsu Metal Works Co., Ltd., Toyama, Japan

[21] Appl. No.: 418,513

[22] Filed: Apr. 7, 1995

[30] Foreign Application Priority Data

Jun. 1, 1994 [JP] Japan ..... 6-120081
Sep. 9, 1994 [JP] Japan ..... 6-242252

[51] Int. Cl.[6] ..... B22D 11/04

[52] U.S. Cl. ..... 164/418; 164/138

[58] Field of Search ..... 164/418, 459, 164/138

[56] References Cited

U.S. PATENT DOCUMENTS 5,014,768 5/1991 Waters et al. ..... 164/418

FOREIGN PATENT DOCUMENTS 55-70453 5/1980 Japan ..... 164/418
57-103759 6/1982 Japan ..... 164/418
62-227554 10/1987 Japan .
63-35762 2/1988 Japan .
63-119955 5/1988 Japan ..... 164/418
1-186245 7/1989 Japan .

*Primary Examiner*—J. Reed Batten, Jr.
*Attorney, Agent, or Firm*—Flynn, Thiel, Boutell & Tanis

[57] ABSTRACT

A mold for continuous casting comprises a copper or copper alloy mold substrate and a sprayed coating film formed on non-blasted inner surfaces of the substrate with or without a metal plated skin layer provided between the substrate and the film. For the formation of the sprayed coating film, particles of at least one tungsten carbide-based wear-resistant material having a particle size of from 5 μm to 53 μm and having a hardness capable of anchoring in the inner surfaces of the substrate are subjected to high pressure/high velocity oxygen fuel coating under conditions where the particles remain at least partially non-fused on application of heat from a spraying flame. By this, a layer directly anchored in the inner surfaces of the substrate or in the skin layer, if present, is formed at least as one layer of the sprayed coating film formed in a total film thickness of from 0.01 to 6 mm. No thermal fusing treatment is necessary since the bonding between the substrate or skin layer and the layer is strong.

18 Claims, 4 Drawing Sheets

MOLD FOR CONTINUOUS CASTING WHICH COMPRISES A FLAME SPRAYED COATING LAYER OF A TUNGSTEN CARBIDE-BASED WEAR-RESISTANT MATERIAL

BACKGROUND OF THE INVENTION

1. Field of the Invention

This invention relates to a mold for continuous casting which has a wear-resistant, flame-sprayed coating film formed on the inner surfaces thereof.

2. Description of the Prior Art

As is known in the art, molds adapted for use in continuous casting and made, for example, of steels include a matrix mold formed of copper or its alloys and a protective layer formed on the inner wall surfaces thereof and made of a wear-resistant material. The protective layers recently proposed, for example, in Japanese laid-open Patent Application Nos. 63-35762 and 1-186245 are ones which are made of a nickel plated layer or a copper plated layer formed on the inner surfaces of the mold and a flame sprayed coating film formed on the plated layer by flame spraying a wear-resistant spraying material such as a Ni-based self-fusing alloy powder or a metal carbide composite material. Another type of protective layer has also been proposed such as in Japanese Laid-open Patent Application No. 62-227554 wherein a nickel simple element which has good miscibility with copper is sprayed against the inner wall surfaces of a mold according to a high-velocity oxygen fuel coating method (hereinafter referred to simply as "HVOF") to form a sprayed coating film, and further forming, on the thus formed sprayed underlying film, several layers of a metal carbide composite material such as cobalt-containing tungsten carbide or its mixture with nickel by flame spraying so that the content of the metal carbide composite material increases from the side of the mold surface toward the side of the protective layer surface.

Where a sprayed coating film is directly formed on the surface of a copper or copper alloy mold according to the flame sprayed coating, it is necessary that the bond strength between the sprayed coating film and the copper or copper alloy be increased. To this end, usual practice is to subject the mold surfaces to blasting prior to the spraying and then to form a film on the blasted surfaces by sprayed coating of a wear-resistant material. The blast treatment is a kind of surface treatment which makes use of steel grits or alumina grits as a blasting material. The grits are collided against the matrix surfaces by entrainment with air under pressure to eliminate contaminants and oxide films such as $Cu_2O$ from the surfaces and also to make coarse irregularities on the matrix surfaces. When a sprayed coating film is formed after having subjected the mold surfaces to the blast treatment, fused particles are anchored in individual irregularities on the matrix surfaces thereby permitting the film to have greater bond strength.

However, when a copper or copper alloy matrix is subjected to the blast treatment, the steel or alumina grits used as a blasting material are liable to remain on the inner wall surfaces of the blasted mold, coupled with another problem that a residual stress may develop in the inner wall surfaces of the mold and the inner wall surfaces may become weakened. This is a serious problem involved in the blast treatment of copper and copper alloys. It will be noted that although not specifically set out in the afore-indicated Japanese Laid-open Patent Application No. 62-227554, where nickel simple element miscible with copper is spray-coated according to the HVOF method to form an underlying layer in order to enhance the strength of bonding with copper or copper alloys, the blast treatment is necessary for the elimination of oxide films from the mold surfaces and for the roughening of the surfaces.

On the other hand, the sprayed coating film is formed on known continuous casting molds according to a spraying method called HVOF wherein the working pressure of a spray gun is not higher than 0.5 MPa (mega pascal), under which the spraying material is fully fused by means of the heat from a spraying flame, making it difficult to intensely anchor the material in the copper or copper alloy substrate (hereinafter referred to simply as "copper substrate" or "substrate"). Accordingly, the bonding force between the substrate and the sprayed coating film is low, and the substrate in the sprayed condition does not stand use.

To avoid this, the known spraying methods essentially require that after completion of the sprayed coating, a high temperature heating treatment (i.e. fusing treatment) at about 900° to 1000° C. be essentially required in order to form a more dense film and to improve the bond strength owing to the formation of the diffusion layer between the sprayed coating film and the substrate (Cu or (Cu+ metal plating)).

However, where the copper substrate, which is made of a non-precipitation hardening material (e.g. pure copper such as deoxidized copper), is subjected to the fusing treatment at about 900° to 1000° C. after the spraying, there arises the problem that the copper substrate considerably lowers with respect to its inherent strength. More particularly, non-precipitation hardening substrates whose strength has been increased owing to the stress caused by cold working have the vital problem in that when they are inevitably recrystallized, the material strength lowers considerably, making it impossible to use such substrates as a casting material. Under these circumstances, it has been usual to use precipitation hardening substrates which are able to restore the strength thereof for use as a casting material through thermal treatment.

In prior art methods where a precipitation hardening material is used as a copper substrate, it is necessary for the reasons set out hereinbefore that the substrate after spraying be subjected to fusing treatment at about 900° to 1000° C., then quenched and finally thermally treated at about 400° C. for precipitation hardening treatment. However, the quenching (with water) of the copper substrate which is to be effected primarily as a solution treatment for restoring the material strength of the copper substrate has the problem that the difference in the coefficient of thermal expansion between the sprayed coating film and the copper substrate is so great that the sprayed coating film may separate or may suffer cracking therein. In this sense, the quenching is in fact impossible and the subsequent thermal treatment cannot be performed to a satisfactory extent. Eventually, this also leads to the vital problem that the copper substrate is not satisfactory with respect to the material strength on use as a mold.

Thus, the known flame sprayed coating methods are disadvantageous in that an additional number of working steps such as the blast treatment prior to the spray coating, the thermal treatment after the spray coating and the like are required and that the working conditions are complicated, resulting in high manufacturing costs. Moreover, in order to keep the wear resistance, the sprayed coating film should be thicker. According to the known HVOF, the film thickness is usually in the range of approximately 0.5 to 1 mm in maximum. A greater thickness involves the problem that the film suffers cracking.

SUMMARY OF THE INVENTION

An object of the invention is to provide a mold for continuous casting which can overcome the problems of the prior art methods.

Another object of the invention is to provide a mold for continuous casting which has good bond strength between the sprayed coating film and the mold substrate or matrix owing to the anchoring effect of the film whereby the mold has a durable and good wear resistance.

A further object of the invention is to provide a mold for continuous casting which is manufactured according to a high pressure/high velocity oxygen fuel coating method (hereinafter referred to simply as "HP/HVOF") wherein a dense sprayed coating film is formed on a mold substrate without use of any blast treatment prior to spray coating and also without use of any thermal treatment after the spray coating.

The above objects can be achieved, according to one embodiment of the invention, by a mold for continuous casting which comprises a copper or copper alloy mold substrate and a sprayed coating film formed on non-blasted inner surfaces of the substrate wherein particles of at least one tungsten carbide-based wear-resistant material having a particle size of from 5 μm to 53 μm and having a hardness capable of anchoring in the inner surfaces of the substrate are subjected to HP/HVOF under conditions where the particles remain at least partially non-fused on application of heat from a spraying flame, thereby forming a layer directly anchored in the inner surfaces of the substrate at least as one layer of the sprayed coating film formed in a total film thickness of from 0.01 to 6 mm whereby the layer is well bonded to the substrate without resorting to any thermal treatment after completion of the high pressure/high velocity oxygen fuel coating.

According to another embodiment of the invention, there is also provided a mold for continuous casting which comprises a copper or copper alloy substrate, and a plated metal skin layer and a sprayed coating film formed on the substrate in this order, wherein particles of at least one tungsten carbide-based wear-resistant material having a particle size of from 5 μm to 53 μm and having a hardness capable of anchoring in the surfaces of the plated metal skin layer are subjected to HP/HVOF under conditions where the particles remain at least partially non-fused on application of heat from a spraying flame, thereby forming a layer directly anchored in the surfaces of the plated metal skin layer at least as one layer of the sprayed coating film formed in a total film thickness of from 0.01 to 6 mm whereby the layer is well bonded to the substrate without resorting to any thermal treatment after completion of the high pressure/high velocity oxygen fuel coating.

In both embodiments, any blast treatment of the inner surface of the substrate prior to the spray coating or any thermal treatment after the spray coating as will be required in prior art methods is not necessary.

Moreover, the sprayed coating film may consist of a single layer structure made of the particles or may have a multi-layer structure including the layer of the particles. More particularly, the sprayed coating layer of the particles may be used as an undercoat layer which is made of at least one WC wear-resistant material. In this case, another type of sprayed coating film made of a Ni-based self-fusible alloy is usually formed on the undercoat layer.

The WC wear-resistant material is generally used in the form of particles having a size or diameter of from 5 to 53 μm and should preferably have a micro Vickers hardness (load: 300 g), $HV_{0.3}$, of 1000 to 1400.

PREFERRED EMBODIMENTS OF THE INVENTION

Figure 1:
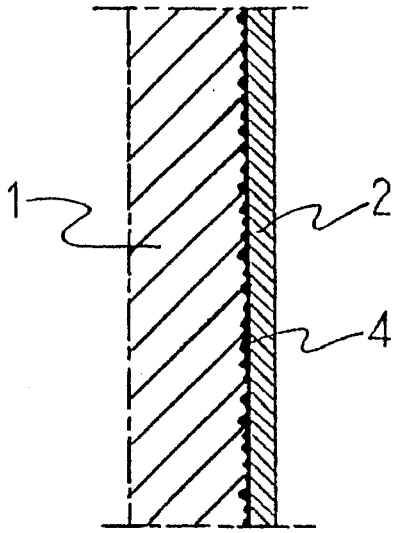
FIG. 1 is a schematic, enlarged, longitudinal section of an essential part of a copper sheet at a shorter side of a mold according to one embodiment of the invention.

The mold of the invention comprises a copper or copper alloy mold substrate and a sprayed coating film formed on non-blasted inner surfaces of the substrate with or without further formation of a metal plated skin layer between the substrate and the sprayed coating film. In the practice of the invention, the sprayed coating film is formed in such a way that particles of at least one tungsten carbide-based wear-resistant material having a particle size of from 5 μm to 53 μm and having a hardness capable of anchoring in the inner surfaces of the substrate are subjected to HP/HVOF under conditions where the particles remain at least partially non-fused on application of heat from a spraying flame.

The HP/HVOF method is a kind of spray coating wherein a spray gun is operated at a pressure of not lower than 0.55 MPa by which a spray coating material can be anchored in the surfaces of a substrate to be spray coated thereby ensuring good bonding between the sprayed coating film and the substrate. In addition, the sprayed coating film formed becomes dense in structure. More particularly, the HP/HVOF method should make use of a spray coating device which comprises a spray gun whose working pressure is not lower than 0.55 MPa under which a sprayed coating film can be formed through so-called plastic impact. The film formation through the plastic impact means a phenomenon wherein when a sprayed powder is collided against a matrix substrate, a film is formed while the powder remains at least partially non-fused and is anchored in the surfaces of the matrix substrate.

The difference between the known HVOF method and the HP/HVOF method of the invention resides not only in the working pressure of the spray gun, but also in that the HP/HVOF method is higher in the velocity of the particles, the Mach number of a spraying jet and the fuel feed pressure and oxygen feed pressure than the known HVOF method and is lower in the jet temperature. This is particularly shown in Table 2. By this, the HP/HVOP method ensures that the particles are not wholly melted by means of the heat from the spraying flame but remain in a semi-fused condition while keeping a hardness capable of anchoring in the substrate and that such particles are spray coated in or on the surfaces of the substrate at a high velocity thereby permitting the resultant film to be strongly bonded to the substrate.

The working pressure of the spray gun used in the HP/HVOF method should theoretically be not lower than 0.55 MPa, preferably from 0.55 MPa to 1.04 MPa. When the working pressure is lower than 0.55 MPa, it is not possible to impart a satisfactory kinetic energy to the particles of a material to be spray coated. On the other hand, when the working pressure exceeds 1.04 MPa, a higher effect of anchoring in the substrate surfaces will not be expected in spite of the increase in the working pressure, with the possible disadvantage that a great residual stress may remain in the substrate surfaces and that the mold may be softened in the surfaces thereof.

The wear-resistant material used at least as a first layer which has a hardness capable of being anchored in the copper substrate or the plated layer and thus shows a good anchoring effect is, for example, a WC-based wear resistant material especially when the working pressure of a spray gun is preferably in the range of from 0.55 MPa to 1.04 MPa. When used in the form of a powder or particles, the material should have a micro Vickers hardness (under a load of 300 g), $HV_{0.3}$, of 1000 to 1400 and a diameter or size of from 5 to 53 μm.

The use of the WC-based wear-resistant material ensures the formation of a sprayed coating film of very high quality without use of any blast treatment. This is because WC (tungsten carbide) has a specific gravity greater than titanium carbide or chromium carbide, so that a higher kinetic energy is optimally obtained when WC is subjected to HP/HVOF.

When the particle size or diameter is smaller than 5 μm, a satisfactory kinetic energy may not be obtained, resulting in insufficient elimination of oxide films from the mold surfaces. Moreover, the powder may not be fully bonded to the substrate, thus being more susceptible to separation of the resultant sprayed coating film. On the contrary, when the powder size exceeds 53 μm, the degree of anchoring in the substrate is not so great that the bond strength will lower. A preferable size of the powder will depend on the type of powder material and the shape of the powder.

Further, when the hardness, $HV_{0.3}$, of the powder is lower than 1000, the degree of anchoring of the powder becomes small. The hardness, $HV_{0.3}$, exceeding 1400 will raise problem that the strain developed in the sprayed coating film becomes great.

The WC-based wear-resistant material for use as a first layer in contact with the substrate or the plated skin layer includes, for example, WC-12 wt % Co (tungsten carbide containing 12 wt % of Co), WC-27 wt % NiCr (tungsten carbide containing 27 wt % of Ni and Cr at a mixing ratio of 4:1) or the like.

The sprayed coating film may be formed as a single layer which is directly formed on or in the inner wall surfaces of a substrate from a WC-based wear-resistant material according to the HP/HVOF method. In order to further improve the wear resistance, the above-stated sprayed coating film may be provided as an undercoat layer (prime coating), on which one or more sprayed coating layers made of wear-resistant materials are formed as a top coat layer or layers. The wear-resistant materials for the sprayed top coat layer may be made of various types of materials. When Ni-based self-fusible alloys are used for the sprayed top coat layer or layers, good results are obtained. This is because the undercoat layer made mainly of WC has good affinity for the Ni-based self-fusible alloys used as the top coat film.

Examples of the Ni-based self-fusible alloys include Ni-Si-B alloys, Ni-Cr-Si-B alloys, Co-Ni-Cr-Si-B alloys, Ni-Cr-Si-WC alloys and the like. In practical applications, those alloys mentioned above to which Mo, Cu, Fe, C and/or the like is added may be used. Preferable compositions comprise 1.25 to 5.50 wt % of Si, 2.00 to 4.50 wt % of B, 8.0 to 18.0 wt % of Cr, 0.30 to 1.00 wt % of C, 1.25 to 5.50 wt % of Fe, 0 to 5 wt % of Cu and 0 to 5 wt % of Mo with the balance being Ni. Moreover, the alloy composition may be changed to form third and subsequent layers.

If a third wear-resistant sprayed coating film layer is formed in addition to a second layer, a Co-based self-fusible alloy may be used as the third layer. Of course, the Co-based self-fusible alloy may be used as a wear-resistant sprayed coating material for second and further layers, like the Ni-based self-fusible alloy. Examples of the Co-based self-fusible alloy include Co-Cr-Si-B alloys to which Fe, C, Ni, Mo and/or W is added. Preferable compositions include 1.5 to 4.5 wt % of Si, 1.5 to 4.0 wt % of B, 16.0 to 24.0 wt % of Cr, 0.25 to 1.50 wt % of C, 1.25 wt % to 5.00 wt % of Fe, 0 to 7.00 wt % of Mo, 0 to 30 wt % of Ni and 4 to 15 wt % of W with the balance being Co.

When the thickness of the sprayed coating film formed on the surfaces of a copper substrate or a plated layer according to the HP/HVOF method should preferably be not greater than 0.01 mm, the mold matrix surface may be partially exposed. This eventually leads to the fact that the oxide film on the matrix surface cannot be satisfactorily removed and a blasting effect as intended by the formation of the undercoat layer cannot be attained. Thus, a good wear resistance is not imparted to the inner surfaces of the mold. In order to impart a good wear resistance, it is preferred to form a thick coating film. In this connection, however, if the thickness exceeds 6 mm, the thermal conductivity lowers owing to the thickness of the film with the attendant disadvantages that the heat-removing effect inherently required for the mold is impeded and that cracks may be formed in the film owing to the strain involved therein. Accordingly, the film thickness is preferably within a range of 0.01 to 6 mm.

The wear-resistant material used to form at least a first layer in contact with the inner wall surfaces of a mold substrate or a metal plated layer formed on the substrate is not fully melted by application of heat from a spraying flame and has a hardness permitting anchoring in the substrate or the plated layer. The working pressure of a spray gun used in the HP/HVOF method should be sufficient for anchoring of the particles of the wear-resistant material and is higher than a working pressure of a spray gun used in known HVOF method. Accordingly, the wear-resistant particles sprayed according to the HP/HVOF method are anchored in and fixedly bonded to the substrate. At the time of the formation of the sprayed coating film, the contaminants (e.g. dirt from the hands and various types of markings) on the substrate surface and films of oxides such as $Cu_2O$ are removed.

In this manner, not only the oxide films are removed from the substrate surface, but also an appropriate degree of surface roughness is imparted to the substrate as intended by the formation of an undercoat layer. As a consequence, a sprayed coating film which has a high bond strength and is unlikely to separate can be formed on the substrate surface without resorting to any blast treatment as a pretreatment prior to spray coating as will be required in prior art methods. Moreover, a higher working pressure is able to impart a greater kinetic energy to the particles, enabling one to obtain a very dense sprayed coating film in an appropriate thickness. This does not necessitate any thermal treatment as will be required in prior art methods in order to improve the adherence of a sprayed coating film and the quality of the film or in order to restore the inherent characteristic properties of the copper substrate.

Reference is now made to the accompanying drawings to illustrate embodiments of the invention, in which like reference numerals indicate like parts.

Figure 2:
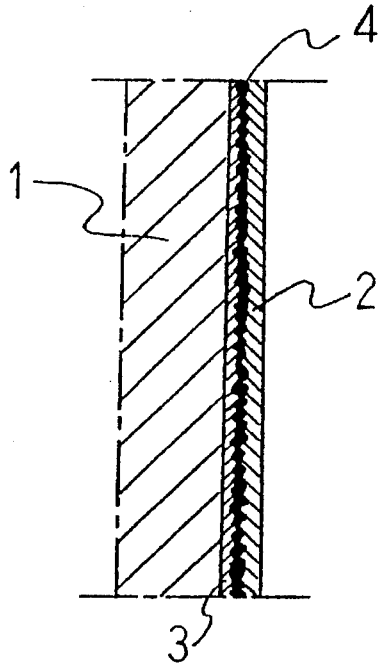
FIG. 2 is a schematic, enlarged, longitudinal section of an essential part of a copper sheet at a shorter side of a mold according to another embodiment of the invention.

FIG. 1 is an enlarged, longitudinal section of an essential part of a copper substrate at a shorter side of a mold according to one embodiment of the invention and FIG. 2 is similar to FIG. 1 and is an enlarged, longitudinal section of an essential part of a copper substrate of a shorter side of a mold according to another embodiment of the invention. In these figures, reference numeral 1 indicates a mold body or substrate formed of a copper or copper alloy, which has a sprayed coating film 2 formed on the inner wall surfaces of the mold substrate 1 and made of a wear-resistant material with or without a metal plated layer 3.

More particularly, in the embodiment of FIG. 1, particles of a WC wear-resistant material which are not fully melted on application of heat from a spraying flame and have a hardness capable of anchoring in the inner walls surfaces of the substrate I are used and directly sprayed against the non-blasted inner wall surfaces of the substrate, thereby forming the spray coated film 2. Reference numeral 4 indicates an anchored layer of the particles.

On the other hand, in the embodiment of FIG. 2, a 0.01 mm thick Ni-plated layer 3 is formed on the surface of the copper substrate 1 as shown, on which the spray coated layer 2 is formed by spray coating a WC wear-resistant material capable of anchoring in the layer 3. The anchored layer 4 is formed between the plated layer 3 and the spray coated film 2.

Figure 3:
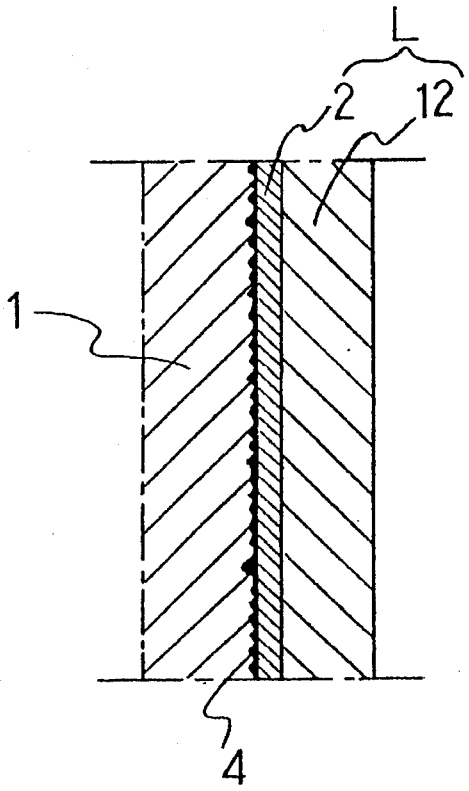
FIG. 3 is a schematic, enlarged, longitudinal section of an essential part of a copper sheet at a shorter side of a mold according to a further embodiment of the invention.

In the embodiment shown in FIG. 3, a second spray-coated film 12 made of a Ni-based self-fusible alloy is further formed on the first spray coated film 2, thereby forming a double-layer structure L. In this embodiment, the first spray coated film 2 serves as an undercoat layer. The second sprayed coating film 12 constitutes a top coat layer.

In the embodiments of FIGS. 1 to 3, the first sprayed coating layer 2 and/or the second sprayed coating film 12 is formed according to the HP/HVOF method. It will be noted that the second sprayed coating film 12 may be formed according to an HVOF method. The fundamental difference between the HP/HVOF and the HVOF resides in the difference in working pressure of a spray gun. The working pressure of the spray gun used in the HVOF is generally less than 0.5 MPa.

Figure 4A:
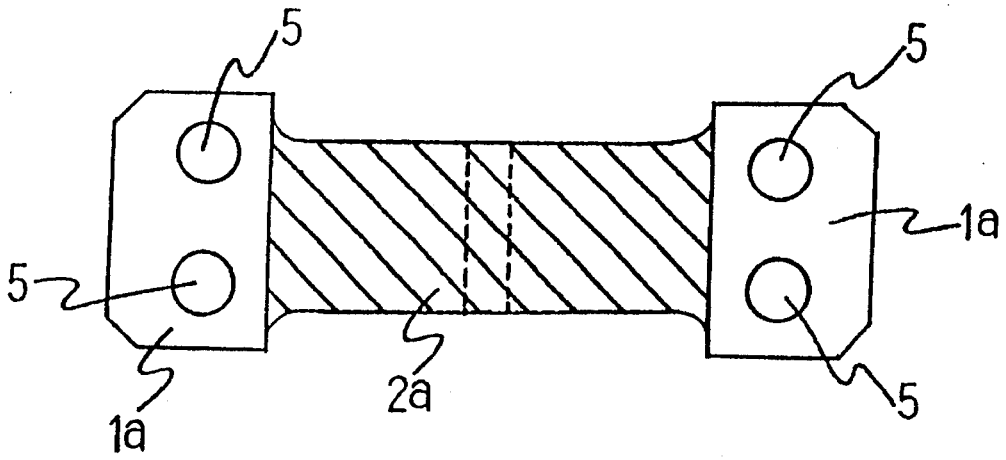
FIGS. 4*a* and 4*b* are, respectively, a plan view and a front view of a piece for thermal shock test.
Figure 4B:
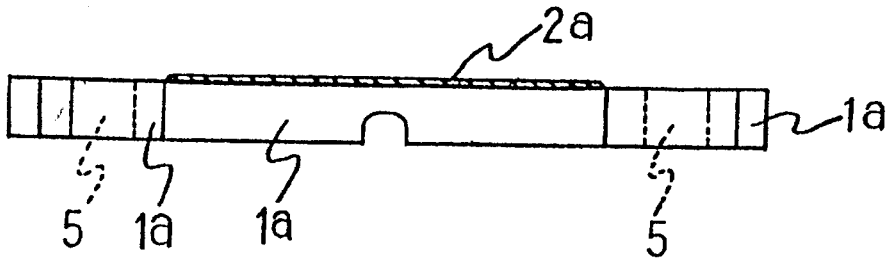

In order to check the mold materials used in the embodiments of FIGS. 1 to 3 with respect to the bond strength and crack susceptibility of a sprayed coating film, and the influence of heat on a copper substrate, test pieces shown in FIGS. 4*a* and 4*b* were made and subjected to a thermal shock test. In FIGS. 4*a* and 4*b*, indicated by 1*a* is a substrate, by 2*a* is a sprayed coating film, and by 5 are holes for attachment.

The compositions and types of copper and copper alloys used as the test substrate are shown in Table 1. The details or conditions of processes (equipments) for carrying out the HP/HVOF and known HVOF used for the test are shown in Table 2 below.

TABLE 1

| Type of Material | Copper and Copper Alloys | Cu | Cr | Zr | Be | Ni | Si | Ag | P |
|---|---|---|---|---|---|---|---|---|---|
| Non-precipitated hardening material | pure copper | bal. | — | — | — | — | — | — | 0.01 |
| | silver-containing copper | bal. | — | — | — | — | — | 0.1 | 0.01 |
| Precipitated hardening material | Cr—Cu | bal. | 1.0 | — | — | — | — | — | — |
| | Cr—Zr—Cu | bal. | 1.0 | 0.2 | — | — | — | — | — |
| | Cu—Ni—Be—Zr | bal. | — | 0.15 | 0.15 | 1.0 | — | — | — |
| | Cu—Ni—Si | bal. | — | — | — | 2.1 | 0.6 | — | — |
| | Cu—Ni—Be | bal. | — | — | 0.5 | 2.0 | — | — | — |

TABLE 2

| | High pressure/high velocity flame oxygen fuel spraying method used in the invention (HP/HVOF) | Known high velocity flame spraying method |
|---|---|---|
| combustion system | internal combustion system | internal combustion system |
| energy source (fuel) | kerosene (oxygen) | propylene (propane, hydrogen) |
| working pressure of gun | 0.82 MPa | 0.41 MPa |
| oxygen feed pressure | 1.23 MPa | 0.98 MPa |
| fuel feed pressure | 1.09 MPa | 0.98 MPa |
| jet temperature | 2800° C. | 3,200° C. |
| Mach value of jet | 2.1 | 1.75 |
| velocity of particles | 870 m/second | 780 m/second |

In Table 2, the term "working pressure of gun" means a measurement of a pressure within a combustion chamber of a spray gun through a pressure sensor. The term "jet temperature" means a calculated value of a flame temperature of individual fuels. The term "Mach value of jet" means a flame velocity calculated from an angle of a diamond pattern shock caused by the impulsive wave developed when the flame velocity exceeds a sound velocity. The term "velocity of particles" means a measurement of the velocity of the particles in the flame at a spraying port of a spray gun by means of a laser Doppler velocimeter.

A wear-resistant sprayed coating film 2*a* was formed on the surface of a substrate 1*a* indicated in Table 1 under spraying conditions indicated in Table 2. The wear-resistant spraying material used as the first layer was made of a WC powder containing 27 wt % of Ni and Cr (at a mixing ratio of Ni and Cr of 80:20) and was formed in a thickness of about 0.8 mm. The second sprayed coating film (top coat layer) was formed by spray coating a Ni-based self-fusible alloy in a thickness of about 2.5 mm. The spraying particles used in the test had, respectively, compositions, particle sizes (or diameters) and hardnesses indicated in Table 3.

TABLE 3

| Spraying Material | Composition (wt %) | Particle size (μm) | Hardness HV (0.3) |
|---|---|---|---|
| WC-12Co alloy | WC:88, Co:12 | 16 to 53 | 1,300 |
| WC-27NiCr alloy | WC:73, Ni,Cr:27 | 16 to 53 | 1,100 |
| Ni-based self-fusible alloy | Ni—Cr—Si—B alloy | 20 to 53 | 600 to 800 |
| Co-based self-fusible alloy | Co—Cr—Si—B alloy | 20 to 53 | 600 to 800 |

The thermal shock test was conducted as follows. Four bolts were inserted into the holes 5 at opposite sides and four corners of a test piece shown in FIGS. 4*a* and 4*b* and were securely clamped and fixed to a given fixing block at a clamping torque of 1000 kgf.cm. Subsequently, the test piece was subjected to 500 heating and cooling cycles wherein the pieces was heated to 300° C. in a cylindrical electric furnace and, after arriving at 300° C., was quenched down to 100° C. by means of water in one cycle. After completion of the 500 heating and cooling cycles, the surface cracks of the sprayed coating film 2*a* were observed. Thereafter, the film 2*a* was cut into pieces to determine whether or not the film 2*a* involved separation and cracking through observation of the section thereof.

TEST EXAMPLE 1

Table 4 shows the results of a test wherein the pure copper indicated in Table 1 was used as a typical example of non-precipitated hardening materials and a sprayed coating film was formed on the pure copper substrate according to a predetermined procedure of making a test piece, followed by evaluation of the sprayed coating film with respect to the influence of a thermal treatment after the flame spraying on the strength (hardness) of the substrate, the bond strength of the sprayed coating film and the results of the sprayed coating film through the thermal shock test. In Tables 4-1 and 4-2, the Ni-plated layer was formed to have a thickness of 100 μm.

TABLE 4-1

| | Examples of Substrates Made of Pure Copper or (Pure Copper + Ni-platred Layer) | | | | | | |
|---|---|---|---|---|---|---|---|
| | | Procedure of Making Test Pieces | | | | | |
| | | blast | | sprayed coating film | | thermal treatment | hardness of substrate |
| | Substrate | treat-ment | spraying method | first layer | second layer | after spraying | after spraying |
| Examples of Invention | | | | | | | |
| 1 | pure copper | no | HP/HVOF | WC-12Co | — | no | $HV_{0.3}$ = 110 |
| 2 | " | no | " | " | * | " | " |
| 3 | " | no | " | WC-27NiCr | — | " | " |
| 4 | " | no | " | " | * | " | " |
| 5 | pure copper + Ni-plated layer | no | " | WC-12Co | — | " | $HV_{0.3}$ of pure Cu = 110 $HV_{0.3}$ of Ni-plated layer = 200 |
| Comparative Example | | | | | | | |
| 6 | pure copper + Ni-plated layer | no | " | — | * | " | $HV_{0.3}$ of pure Cu = 110 $HV_{0.3}$ of Ni- |

TABLE 4-1-continued

| | Examples of Substrates Made of Pure Copper or (Pure Copper + Ni-platred Layer) | | | | | | |
|---|---|---|---|---|---|---|---|
| | | Procedure of Making Test Pieces | | | | | |
| | | blast | | sprayed coating film | | thermal treatment | hardness of substrate |
| | Substrate | treat-ment | spraying method | first layer | second layer | after spraying | after spraying |
| | | | | | | | plated layer = 200 |
| References | | | | | | | |
| 1 | pure copper | no | HVOF | WC-12Co | — | yes | $HV_{0.3}$ = 45 |
| 2 | " | no | " | — | * | no | $HV_{0.3}$ = 110 |
| 3 | " | yes | " | WC-12Co | * | yes | $HV_{0.3}$ = 45 |
| 4 | pure copper + Ni-plated layer | no | " | " | — | yes | $HV_{0.3}$ of pure Cu = 110 $HV_{0.3}$ of Ni-plated layer = 200 |
| 5 | pure copper + Ni-plated layer | yes | " | — | * | yes | $HV_{0.3}$ of pure Cu = 110 $HV_{0.3}$ of Ni-plated layer = 200 |

Note
*: Ni-based self-fusible alloy

TABLE 4-2

| | Sprayed coating film bond strength | Evaluation of sprayed coating film by thermal shock test | |
|---|---|---|---|
| | (kgf/mm$^2$) | surface cracking | separation |
| Examples of Invention | | | |
| 1 | 14 | not cracked | no |
| 2 | 14 | " | " |
| 3 | 13 | " | " |
| 4 | 13 | " | " |
| 5 | 15 | " | " |
| Comparative Example | | | |
| 6 | 5 | slightly cracked | yes |
| References | | | |
| 1 | 2.7 | moderately cracked | yes |
| 2 | 1.5 | substantially cracked | " |
| 3 | 6.0 | " | " |
| 4 | 8.0 | moderately cracked | " |
| 5 | 7.0 | " | " |

As will be apparent from the results of the above tables, where a sprayed coating film was formed according to the known HVOF method using the blast treatment of the pure copper substrate and the thermal treatment after the spraying, the hardness of the substrates considerably lowers to about less than ½ of hardness of the examples. Since the hardness of the substrate thus lowers, the pure copper (non-precipitated hardening material) has never been in use as a substrate on which a sprayed coating film is formed. As a matter of course, if the thermal treatment is not effected after the flame spraying, the substrate does not lower in hardness. Nevertheless, the bond strength of the sprayed coating film is about 1.5 kgf/mm$^2$, which is about 1/10 of the strength in the examples of the invention. In case where the blast treatment and the thermal treatment after the spraying are effected, the bond strength is only about ½ of the strength of the examples of the invention. This reveals that when a metal or alloy is spray coated according to the known HVOF wherein the working pressure of a spray gun is low, the anchoring in the substrate is not satisfactory. Similar test results are obtained when using a substrate of Cr-Cu which is a precipitated hardening material.

TEST EXAMPLE 2

A substrate of Cr-Zr-Cu alloy which is typical of a precipitated hardening material was used, on which a spray coated film or films were formed to evaluate the film or films in comparison with those films obtained according to the known method. The results are shown in Tables 5-1 and 5-2.

TABLE 5-1

| Test No. | Substrate | blast treatment | spraying method | first layer | second layer | thermal treatment after spraying | hardness of substrate after spraying |
|---|---|---|---|---|---|---|---|
| | Examples of Substrates Made of Cr—Zr—Cu or (Cr—Zr—Cu + Ni-plated Layer) | Procedure of Making Test Pieces | | | | | |
| | | | | sprayed coating film | | | |
| Examples of Invention | | | | | | | |
| 7 | Cr—Zr—Cu | no | HP/HVOF | WC-12Co | — | no | $HV_{0.3}$ = 130 |
| 8 | " | no | " | " | * | " | " |
| 9 | " | no | " | WC-27NiCr | — | " | " |
| 10 | " | no | " | " | * | " | " |
| 11 | Cr—Zr—Cu + Ni-plated layer | no | " | WC-12Co | — | " | $HV_{0.3}$ of Cr—Zr—Cu = 130 $HV_{0.3}$ of Ni-plated layer = 200 |
| Comparative Example | | | | | | | |
| 12 | Cr—Zr—Cu + Ni-plated layer | no | " | — | * | " | $HV_{0.3}$ of Cr—Zr—Cu = 130 $HV_{0.3}$ of Ni-plated layer = 200 |
| References | | | | | | | |
| 6 | Cr—Zr—Cu | no | HVOF | WC-12Co | — | yes | $HV_{0.3}$ = 100 |
| 7 | " | no | " | — | * | no | $HV_{0.3}$ = 130 |
| 8 | " | yes | " | WC-12Co | * | yes | $HV_{0.3}$ = 100 |
| 9 | Cr—Zr—Cu + Ni-plated layer | no | " | " | — | yes | $HV_{0.3}$ of Cr—Zr—Cu = 100 $HV_{0.3}$ of Ni-plated layer = 60 |
| 10 | Cr—Zr—Cu + Ni-plated layer | yes | " | — | * | yes | $HV_{0.3}$ of Cr—Zr—Cu = 100 $HV_{0.3}$ of Ni-plated layer = 60 |

Note
*: Ni-based self-fusible alloy

TABLE 5-2

| | Sprayed coating film bond strength (kgf/mm²) | Evaluation of sprayed coating film by thermal shock test: surface cracking | separation |
|---|---|---|---|
| Examples of Invention | | | |
| 7 | 18 | not cracked | no |
| 8 | 18 | " | " |
| 9 | 17 | " | " |
| 10 | 17 | " | " |
| 11 | 19 | " | " |
| Comparative Example | | | |
| 12 | 7 | slightly cracked | slightly separated |

TABLE 5-2-continued

| | Sprayed coating film bond strength (kgf/mm²) | Evaluation of sprayed coating film by thermal shock test: surface cracking | separation |
|---|---|---|---|
| References | | | |
| 6 | 3.0 | moderately cracked | yes |
| 7 | 1.9 | substantially cracked | " |
| 8 | 4.8 | slightly cracked | " |
| 9 | 8 | slightly cracked | slightly separated |
| 10 | 10 | " | no |

Figure 5:
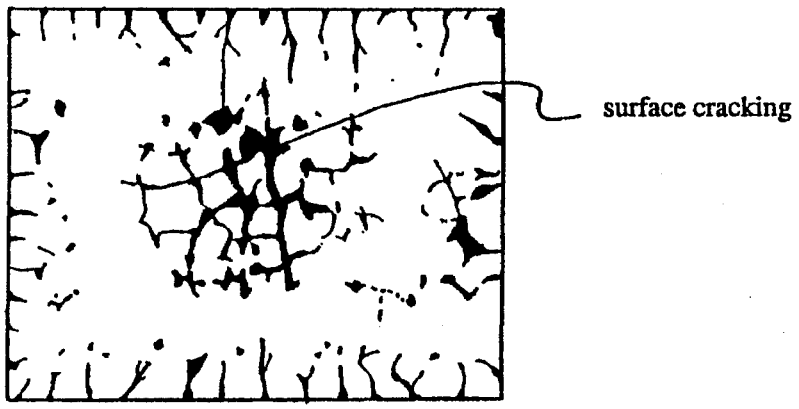
FIG. 5 PRIOR ART
FIG. 5 is an illustrative view of a sprayed coating film surface of a known mold enlarged to 1.2 magnifications.

As will be apparent by comparison between the results of Tables 4 and 5, the bond strength and thermal shock test of the sprayed coating films according to the examples of the invention are better than those of the references of the prior art method, like the case of the pure copper substrate. Moreover, when the substrate is made of the precipitated hardening Cr-Zr-Cu alloy, the bonding strength between the sprayed coating film and the substrate is higher than that attained by use of the pure copper. Thus, such a precipitated hardening alloy is preferred for use as a substrate on which a sprayed coating film is formed. FIG. 5 shows the surface state of the sprayed coating film of the mold of Reference 8 in Table 5 enlarged to 1.2 magnifications. As shown in the figure, the film of the reference suffers the surface cracking. In all the examples of the invention, no cracking took place.

Figure 6A:
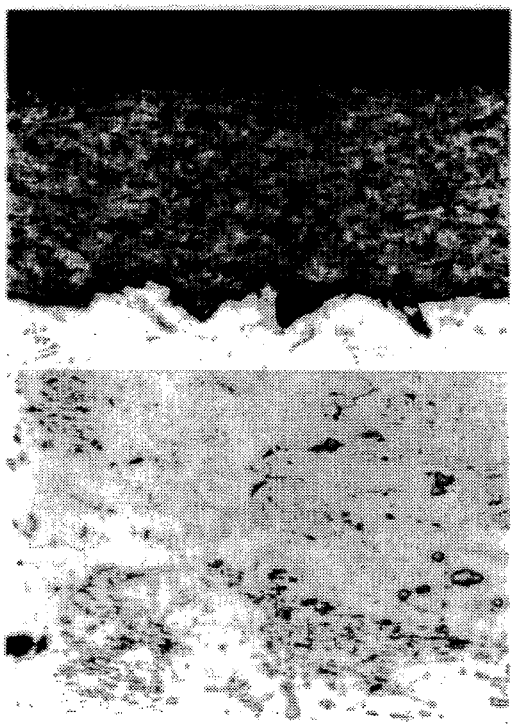
FIG. 6a PRIOR ART
FIGS. 6*a* and 6*b* are, respectively, a photograph (of 150 magnifications) of a metallic microstructure at the section of the interface between the sprayed coating film and the substrate of a known mold and an illustrative, diagrammatically depicted view of the structure.
Figure 6B:
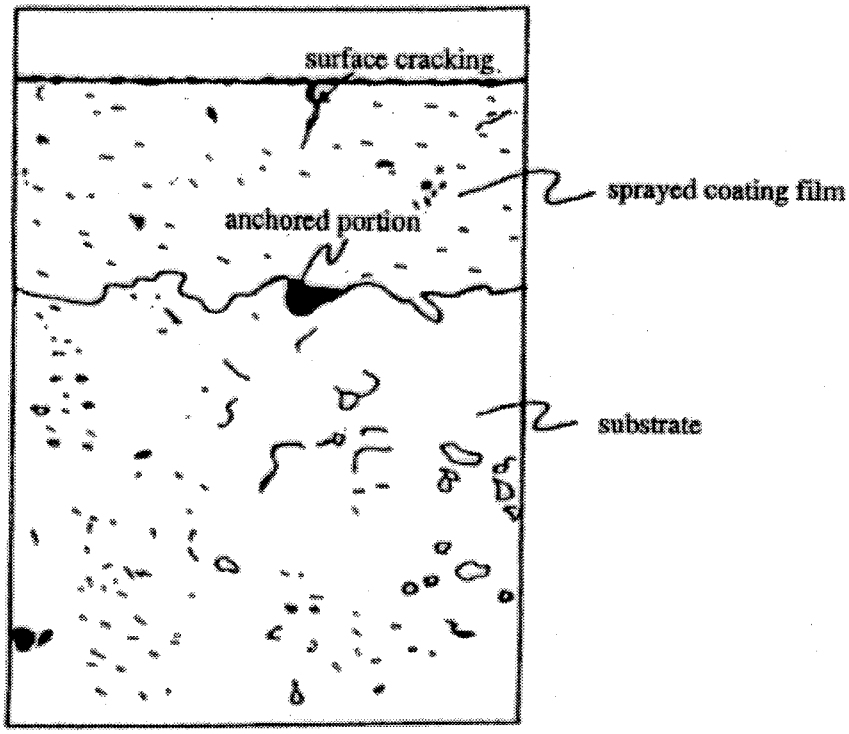
FIG. 6b PRIOR ART

FIGS. 6*a* and 6*b* are, respectively, a photograph of a metallic microstructure at the interfacial section of the sprayed coating film and the substrate and an illustrative view based on the photograph. From the microstructure of these figures, it will be seen that the degree of the anchoring of the sprayed material is not satisfactory.

Figure 7A:
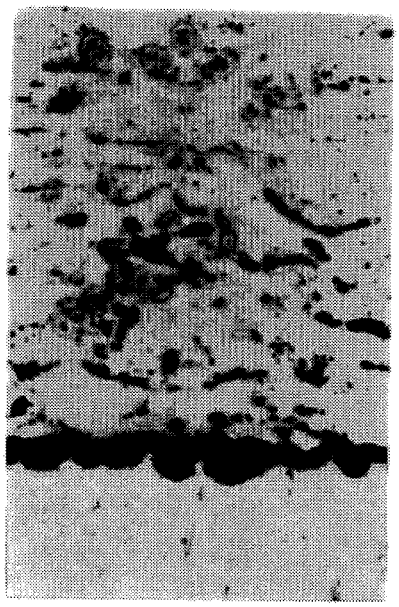
FIGS. 7*a* and 7*b* are, respectively, a photograph (of 150 magnifications) of a metallic microstructure at the section of the interface between the sprayed coating film and the substrate of a mold according to the invention and an illustrative, diagrammatically depicted view of the structure.
Figure 7B:
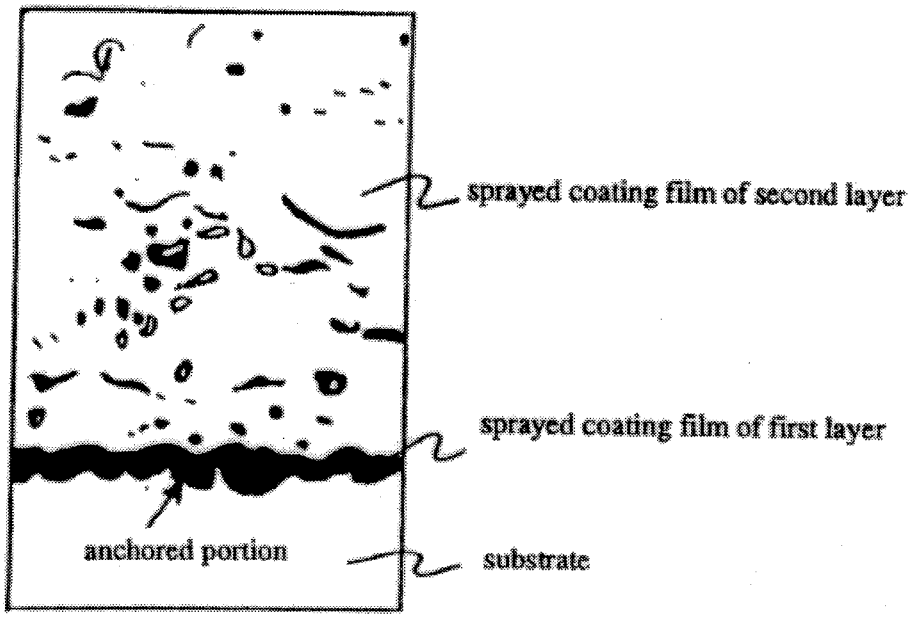

FIGS. 7*a* and 7*b* are, respectively, a photograph of a metallic microstructure at the interfacial section of the sprayed coating film and the substrate of the mold of Example 8 in Table 5 and an illustrative view based on the photograph. The microstructure reveals that the anchoring in the substrate is satisfactory. In FIGS. 7*a* and 7*b*, the first layer is made of the WC-12Co alloy and the second layer is made of the Ni-based self-fusible alloy. It will be noted that when the substrate is made of silver-containing copper, Cu-Ni-Be-Zr, Cu-Ni-Si or Cu-Ni-Be, similar results as in the Cr-Zr-Cu substrate are obtained on comparison with the references.

TEST EXAMPLE 3

A first layer made of WC-12Co was spray coated on various types of substrates, on which a Ni-based self-fusible alloy was formed as a second layer, followed by subjecting to a thermal shock test to determine the relation between the thickness of the film and the crack susceptibility of the film. The results are shown in Tables 6-1 and 6-2.

TABLE 6-1

| Relation Between The Film Thickness and The Crack Susceptibility of The Film | | | | | | |
|---|---|---|---|---|---|---|
| | | Procedure of Making Test Pieces | | | | |
| | | | | sprayed coating film | | |
| Test No. | Substrate | blast treat-ment | spraying method | first layer (thickness by mm) | second layer (thickness by mm) | total film thickness (mm) |
| Examples of Invention | | | | | | |
| 13 | Cr—Zr—Cu | no | HP/HVOF | WC-12Co (1) | no | 1 |
| 14 | " | no | " | WC-12Co (0.05) | Ni-based self-fusible alloy (0.95) | 1 |
| 15 | pure copper | no | " | WC-12Co (0.05) | Ni-based self-fusible alloy (4.95) | 5 |
| 16 | Cr—Zr—Cu | no | " | WC-12Co (0.05) | Ni-based self-fusible alloy (3.95) | 4 |
| 17 | " | no | " | WC-12Co (7) | — | 7 |
| 18 | " | no | " | WC-12Co (0.05) | Ni-based self-fusible alloy (5.95) | 6 |

TABLE 6-2

| | Evaluation of sprayed coating film by thermal shock test | |
|---|---|---|
| | film surface cracking | film separation |
| Examples of Invention | | |
| 13 | not cracked | no |
| 14 | " | " |
| 15 | slightly cracked | " |
| 16 | not cracked | " |
| 17 | slightly cracked | " |
| 18 | not cracked | " |

According to the results of Tables 6-1 and 6-2, as the thickness of the sprayed coating film increases, the film is more likely to suffer surface cracking. Where the substrate is made of pure copper, the surface cracking takes place at a total thickness of 5 mm. With a substrate made of a precipitated hardening material, e.g. with a Cr-Zr-Cu substrate, when a WC-12Co single layer having a high hardness is formed in a thickness of 7 mm, surface cracking was recognized slightly. In this connection, when the first layer is made of WC-12Co in a thickness of 0.05 mm and the second layer is made of a Ni-based self-fusible alloy in a thickness of 5.96 mm with a total thickness of 6 mm, no cracking was recognized. When the film thickness is not smaller than 0.01 mm, a good wear resistance is ensured. In view of the above, a preferable thickness ranges from 0.01 to 6 mm.

As will be apparent from the foregoing, when a substrate is subjected to flame spray coating according to the invention, the dirt or oxide films such as $Cu_2O$ can be removed from the surfaces of the substrate while forming a sprayed coating film on the substrate. At the same time, the particles of a spray coating material can be satisfactorily anchored in the substrate to ensure high bond strength of the sprayed coating film. Thus, the film is unlikely to separate from the substrate. In addition, the sprayed coating film formed is very dense. In the practice of the invention, the thermal treatment after the spray coating which has been conventionally performed in order to improve characteristic properties of substrate materials is not required at all.

The thermal treatment after the spray coating which is essentially required in prior art methods is disadvantageous in that for the mold made of non-precipitated hardening materials, the material strength lowers and the material cannot be used as a substrate for spray coating. In accordance with the invention, the mold made of a non-precipitated hardening material (e.g. pure copper) may be applied with a sprayed coating film on the inner surfaces thereof.

The thickness of the sprayed coating film formed according to the known HVOF is in the range of from 0.5 to 1 mm in maximum. A greater thickness involves the problem that such a film suffers cracking. In contrast, according to the invention, the film may be formed in a thickness of up to 6 mm in maximum, thus significantly improving the durability in wear resistance.

What is claimed is:

1. A mold for continuous casting which comprises a copper or copper alloy mold substrate and a sprayed coating film formed on non-blasted inner surfaces of the substrate wherein particles of at least one tungsten carbide-based wear-resistant material having a particle size of from 5 μm to 53 μm and having a hardness capable of anchoring in the inner surfaces of the substrate are subjected to high pressure/high velocity oxygen fuel coating under conditions where the particles remain at least partially non-fused on application of heat from a spraying flame, thereby forming a layer directly anchored in the inner surfaces of the substrate at least as one layer of the sprayed coating film formed in a total film thickness of from 0.01 to 6 mm whereby said layer is well bonded to said substrate without resorting to any thermal treatment after completion of the high pressure/high velocity oxygen fuel coating.

2. A mold according to claim 1, wherein said particles have a micro Vickers hardness, $HV_{0.3}$, of 1000 to 1400 under a load of 300 g.

3. A mold according to claim 1, wherein said sprayed coating film consists of said layer directly anchored in the inner surfaces of the substrate.

4. A mold according to claim 1, wherein said at least one tungsten carbide-based wear-resistant material consists of tungsten carbide containing 12 wt % of Co or tungsten carbide containing 27 wt % of Ni and Cr at a ratio by weight of 4:1.

5. A mold according to claim 1, further comprising at least one top coat layer formed on the directly anchored layer, said at least one top coat layer being a sprayed coated film made of a Ni-based self-fusible alloy or a Co-based self-fusible alloy.

6. A mold according to claim 5, wherein said at least one top coat layer consists of said Ni-based self-fusible alloy comprising 1.25 to 5.50 wt % of Si, 2.00 to 4.50 wt % of B, 8.0 to 18.0 wt % of Cr, 0.30 to 1.00 wt % of C, 1.25 to 5.50 wt % of Fe, up to 5 wt % of Cu, up to 5 wt % of Mo and the balance being Ni.

7. A mold according to claim 5, where said at least one top coat layer consists of said Co-based self-fusible alloy comprising 1.5 to 4.5 wt % of Si, 1.5 to 4.0 wt % of B, 16.0 to 24.0 wt % of Cr, 0.25 to 1.50 wt % of C, 1.25 to 5.00 wt % of Fe, up to 7.00 wt % of Mo, up to 30 wt % of Ni, 4 to 15 wt % of W and the balance being Co.

8. A mold according to claim 1, wherein a spray gun used in the high pressure/high velocity oxygen fuel coating method is operated at a working pressure of from 0.5 to 1.04 MPa.

9. A mold for continuous casting which comprises a copper or copper alloy substrate, and a plated metal skin layer and a sprayed coating film formed on the substrate in that order, wherein particles of at least one tungsten carbide-based wear-resistant material having a particle size of from 5 μm to 53 μm and having a hardness capable of anchoring in the surfaces of the plated metal skin layer are subjected to high pressure/high velocity oxygen fuel coating under conditions where the particles remain at least partially non-fused on application of heat from a spraying flame, thereby forming a layer directly anchored in the surfaces of the plated metal skin layer at least as one layer of the sprayed coating film formed in a total film thickness of from 0.01 to 6 mm whereby said layer is well bonded to said substrate without resorting to any thermal treatment after completion of the high pressure/high velocity oxygen fuel coating.

10. A mold according to claim 9, wherein said particles have a micro Vickers hardness, $HV_{0.3}$, of 1000 to 1400 under a load of 300 g.

11. A mold according to claim 9, wherein said sprayed coating film consists of said layer directly anchored in the inner surfaces of the substrate.

12. A mold according to claim 9, wherein said at least one tungsten carbide-based wear-resistant material consists of tungsten carbide containing 12 wt % of Co or tungsten carbide containing 27 wt % of Ni and Cr at a ratio by weight of 4:1.

13. A mold according to claim 9, further comprising at least one top coat layer formed on the directly anchored layer, said at least one top coat layer being a sprayed coated film made of a Ni-based self-fusible alloy or a Co-based self-fusible alloy.

14. A mold according to claim 13, wherein said at least one top coat layer consists of said Ni-based self-fusible alloy comprising 1.25 to 5.50 wt % of Si, 2.00 to 4.50 wt % of B, 8.0 to 18.0 wt % of Cr, 0.30 to 1.00 wt % of C, 1.25 to 5.50 wt % of Fe, up to 5 wt % of Cu, up to 5 wt % of Mo and the balance being Ni.

15. A mold according to claim 13, where said at least one top coat layer consists of said Co-based self-fusible alloy comprising 1.5 to 4.5 wt % of Si, 1.5 to 4.0 wt % of B, 16.0 to 24.0 wt % of Cr, 0.25 to 1.50 wt % of C, 1.25 to 5.00 wt % of Fe, up to 7.00 wt % of Mo, up to 30 wt % of Ni, 4 to 15 wt % of W and the balance being Co.

16. A mold according to claim 9, wherein a spray gun used in the high pressure/high velocity oxygen fuel coating method is operated at a working pressure of from 0.5 to 1.04 MPa.

17. A mold according to claim 9, wherein said plated metal skin layer is made of Ni.

18. A mold according to claim 9, wherein said plated metal skin layer is made of Ni-Fe.

* * * * *